US012753599B2

(12) United States Patent
Doerr

(10) Patent No.: US 12,753,599 B2
(45) Date of Patent: Oct. 6, 2026

(54) BIDET APPARATUS

(71) Applicant: Dookie LLC, Denver, CO (US)

(72) Inventor: Daniel Doerr, Denver, CO (US)

(73) Assignee: Dookie LLC, Denver, CO (US)

( * ) Notice: Subject to any disclaimer, the term of this patent is extended or adjusted under 35 U.S.C. 154(b) by 10 days.

(21) Appl. No.: 19/373,842

(22) Filed: Oct. 30, 2025

(65) Prior Publication Data

US 2026/0117506 A1 Apr. 30, 2026

Related U.S. Application Data

(60) Provisional application No. 63/764,092, filed on Feb. 27, 2025, provisional application No. 63/714,455, filed on Oct. 31, 2024.

(51) Int. Cl.
*E03D 9/08* (2006.01)

(52) U.S. Cl.
CPC ..... *E03D 9/08* (2013.01)

(58) Field of Classification Search
CPC ..... A61H 35/00; A47K 3/26; E03D 9/08
USPC ..... 4/443, 448
See application file for complete search history.

(56) References Cited

U.S. PATENT DOCUMENTS 4,691,391 A * 9/1987 Kuo ..... E03D 9/08 4/420.4
11,499,304 B1 * 11/2022 Bensing ..... F16K 11/08
2011/0041243 A1 * 2/2011 Kwon ..... E03D 9/08 4/443
2022/0162843 A1 * 5/2022 Gupta ..... E03D 9/08

* cited by examiner

*Primary Examiner* — Lauren A Crane
(74) *Attorney, Agent, or Firm* — Hall Estill Law Firm

(57) ABSTRACT

A bidet apparatus for controlling the flow of fluid. The bidet apparatus can include a valve assembly including a rotary valve disc and a stationary valve disc wherein the rotary valve disc includes an opening and a sprayer apparatus in fluid communication with the valve assembly. The valve assembly provides a washing fluid to an outside surface of a sprayer of the sprayer apparatus and to an inside part of the sprayer and a nozzle disposed within the sprayer. The bidet apparatus also includes a wash port disposed in the stationary valve disc for providing the washing fluid to the outside surface of the sprayer and a spray port disposed in the stationary valve disc to direct the washing fluid to the inside part of the sprayer and the nozzle.

20 Claims, 8 Drawing Sheets

BIDET APPARATUS

CROSS-REFERENCE TO RELATED APPLICATIONS

The present application is a conversion of U.S. Provisional Application having U.S. Ser. No. 63/714,455, filed Oct. 31, 2024, and U.S. Provisional Application having U.S. Ser. No. 63/764,092, filed Feb. 27, 2025, which claim the benefit under 35 U.S.C. 119(e). The disclosures of which are hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a bidet apparatus, and more particularly, to a bidet apparatus having a unique valve assembly and a unique nozzle adjustment mechanism.

2. Description of the Related Art

Generally, bidets installed adjacent to toilet seats clean certain portions of a person's body by dispensing water from a bidet apparatus. Various mechanisms are used to control the flow of water to a nozzle of a sprayer assembly and there can be certain disadvantages to these flow control mechanisms.

Typically, nozzles extend and retract from a housing when a cleaning operation is initiated by a user of the bidet apparatus. While the nozzles can extend and contract, they can be limited to one angle of position from the housing. Bidets that do have an ability to adjust the angle the nozzles are positioned are often easily moved off the angle they are adjusted to.

Accordingly, there is a need for a bidet apparatus, and more particularly, to a bidet apparatus having a unique valve assembly to overcome deficiencies associated with current valve assemblies and a unique nozzle adjustment mechanism to provide more than one angle of position for a nozzle.

SUMMARY OF THE DISCLOSURE

The present disclosure is directed to a bidet apparatus for controlling the flow of fluid. The bidet apparatus can include a valve assembly including a rotary valve disc and a stationary valve disc wherein the rotary valve disc includes an opening and a sprayer apparatus in fluid communication with the valve assembly. The valve assembly provides a washing fluid to an outside surface of a sprayer of the sprayer apparatus and to an inside part of the sprayer and a nozzle disposed within the sprayer. The bidet apparatus also includes a wash port disposed in the stationary valve disc for providing the washing fluid to the outside surface of the sprayer and a spray port disposed in the stationary valve disc to direct the washing fluid to the inside part of the sprayer and the nozzle.

DETAILED DESCRIPTION OF THE DISCLOSURE

Figure 1A:
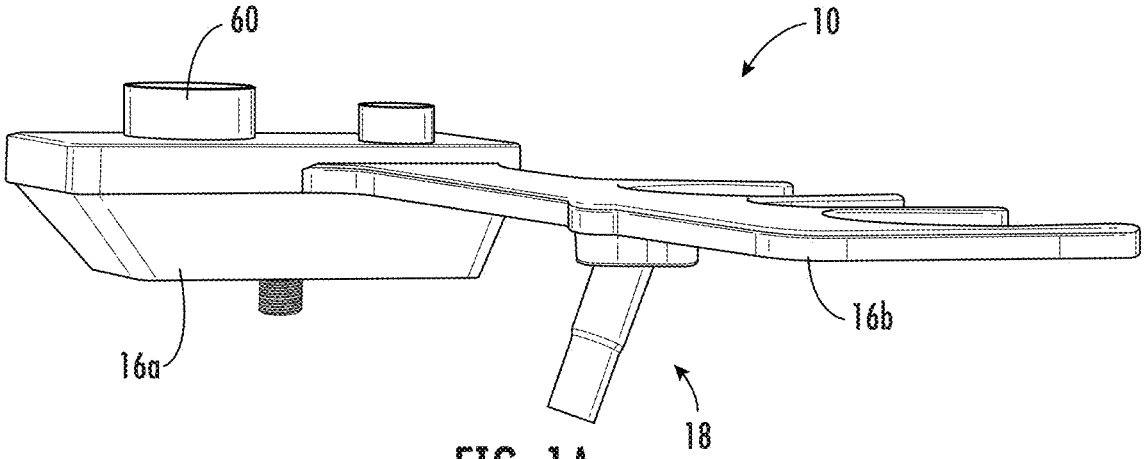
FIG. 1A is a perspective view of a bidet apparatus showing a sprayer in a first position constructed in accordance with the present disclosure.
Figure 1B:
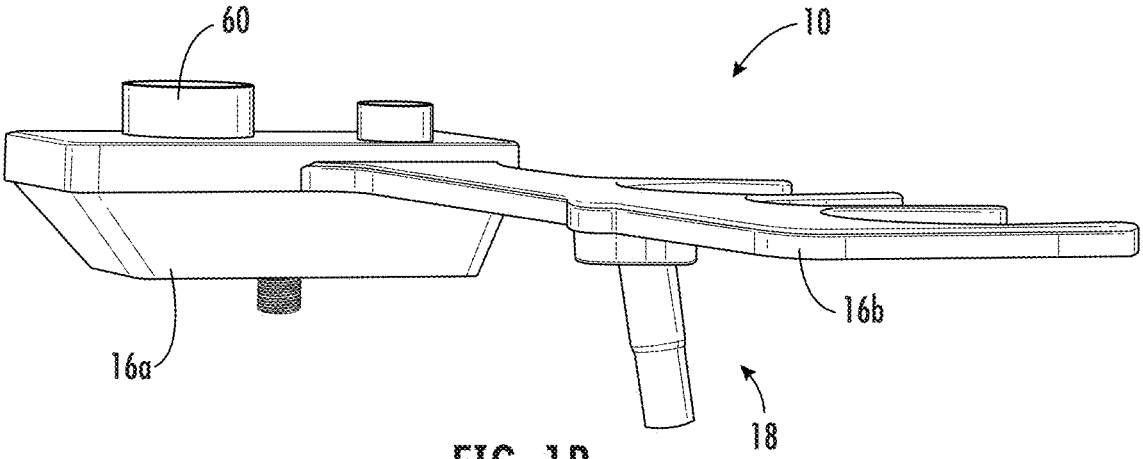
FIG. 1B is a perspective view of the bidet apparatus showing the sprayer in a second position constructed in accordance with the present disclosure.
Figure 2A:
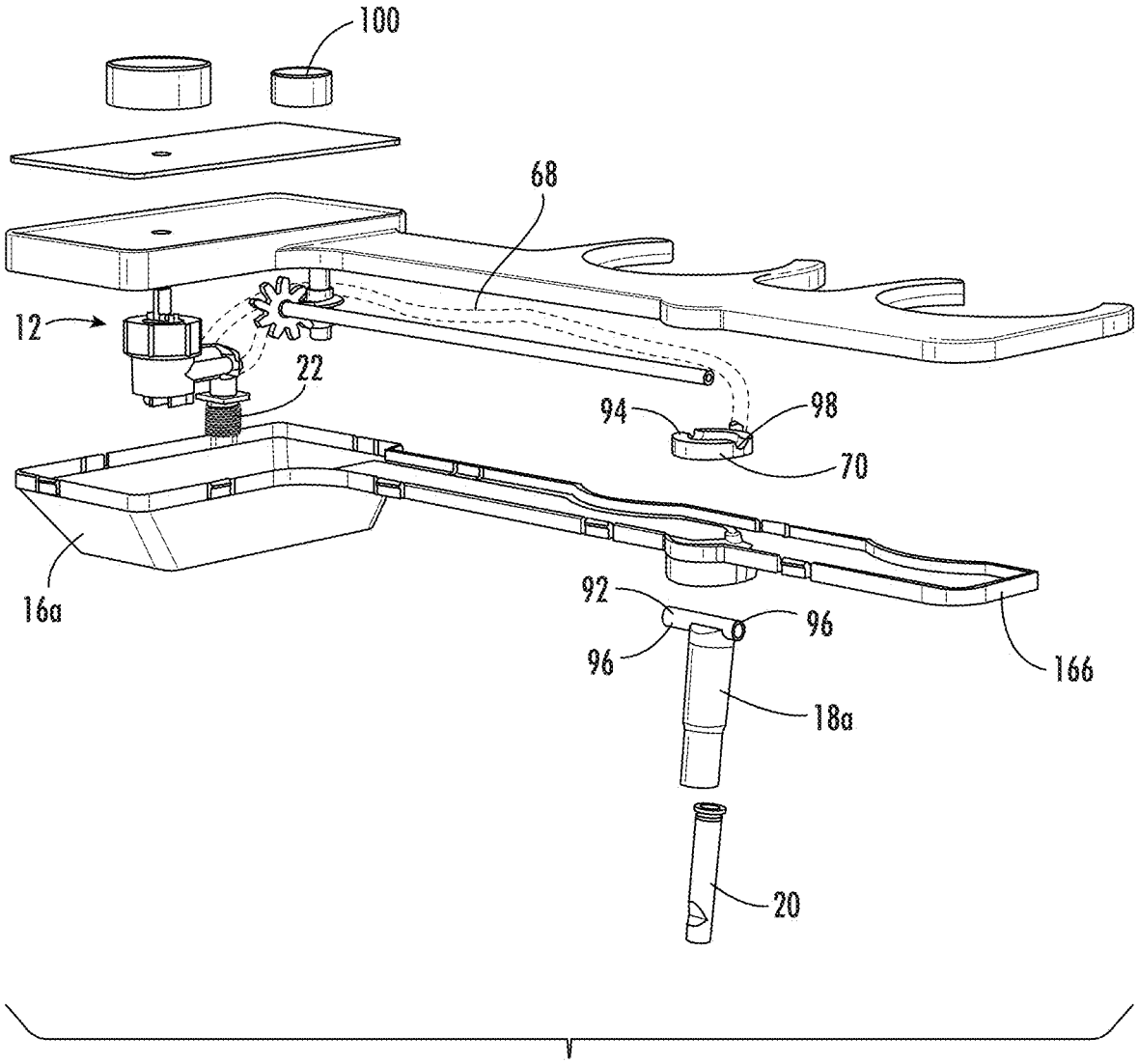
FIG. 2A is an exploded view of the bidet apparatus constructed in accordance with the present disclosure.
Figure 2B:
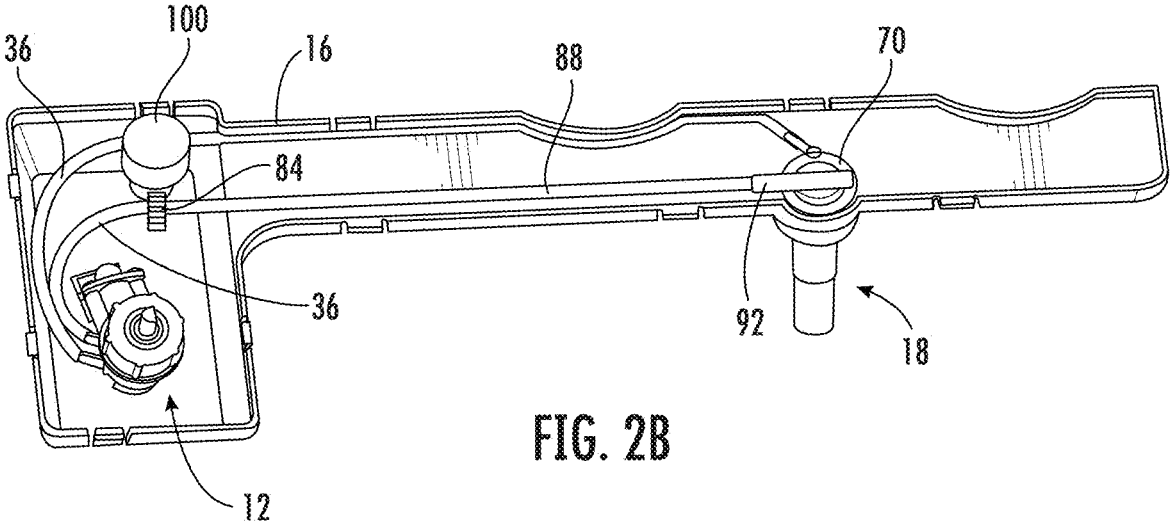
FIG. 2B is a perspective view of a part of the bidet apparatus constructed in accordance with the present disclosure.

Referring now to FIGS. 1A-2B, the present disclosure is related to a bidet apparatus 10 having a unique valve assembly 12 and a unique nozzle adjustment mechanism 14. The bidet apparatus 10 includes a housing 16 for encapsulating parts of the bidet apparatus 10, a sprayer apparatus 18 supported by the housing 16 for delivering washing fluid (or water), and the valve assembly 12 for controlling the flow of the washing fluid from a washing fluid source (not shown) to the sprayer apparatus 18. The housing 16 can be made up of an operational housing 16*a* and a sprayer housing 16*b*. The operational housing 16*a* includes various operation components of the bidet apparatus 10 and the sprayer housing 16*b* supports/houses various components related to the sprayer apparatus 18 of the bidet apparatus 10. The bidet apparatus 10 can also include the nozzle adjustment assembly 14 to vary the angle of position of a nozzle 20 of the sprayer apparatus 18.

Figure 3:
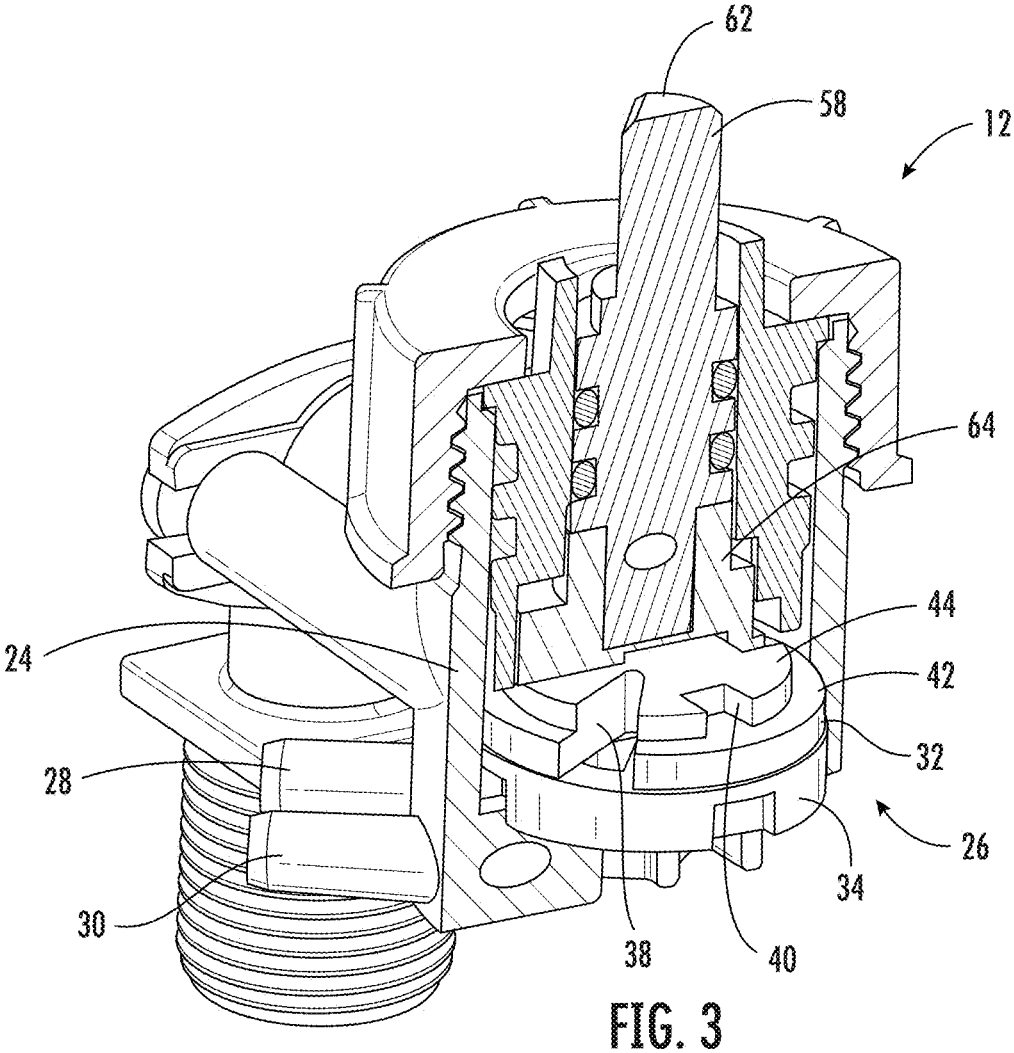
FIG. 3 is a cross-sectional, perspective view of a valve assembly of the bidet apparatus constructed in accordance with the present disclosure.

Referring now to FIG. 3, the valve assembly 12 can include an inlet 22 for receiving the washing fluid from the washing fluid source and directing the washing fluid to a valve housing 24. The valve housing 24 can be supported in the operational housing 16*a* portion of the housing 16. The valve assembly 12 can also include an actuation assembly 26 for opening and closing the valve assembly 12 to permit the washing fluid to flow to the sprayer apparatus 18 via a wash outlet 28 and a spray outlet 30. The valve housing 24 can encapsulate a rotary valve disc 32 and a stationary valve disc 34 that cooperate with the actuation assembly 26 to control the flow of washing fluid through the valve assembly 12. The wash outlet 28 directs water to the sprayer apparatus 18 to flow over the nozzle 20 to wash it after each use and prior to the next use. The spray outlet 30 directs the water to the sprayer apparatus 18 and to the nozzle 20 to conduct a cleaning after a person uses the toilet. The spray outlet 30 and the wash outlet 28 can be fluidically connected to the sprayer apparatus 18 via conduits or tubing 36.

Figure 4:
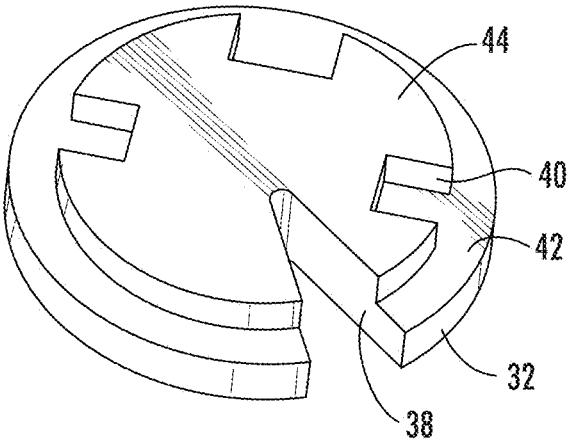
FIG. 4 is a perspective view of a rotary valve disc of the bidet apparatus constructed in accordance with the present disclosure.

Referring now to FIGS. 3 and 4, the rotary valve disc 32 can be rotatably disposed adjacent to the stationary valve disc 34 and between the actuation assembly 26 and the stationary valve disc 34. The actuation assembly 26 engages the rotary valve disc 32 to rotate the rotary valve disc 32 to prevent or allow the flow of washing fluid through the valve assembly 12. The rotary valve disc 32 includes an axially directed port 38 disposed therein to allow fluid to flow therethrough. The rotary valve disc 32 can also include depression areas 40, or notches, for the actuation assembly 26 to engage to rotate the rotary valve disc 32. In one embodiment, the rotary valve disc 32 can include a lower disc portion 42 and an upper disc portion 44 and the port 38 extends through both disc portions and the depression areas 40 are disposed in the upper disc portion 44. The port 38 can have any shape such that fluid can flow through the rotary valve disc 32 as desired. In one embodiment, the port 38 has a triangular shape such that one side of the triangular shaped port 38 is at the edge of the rotary valve disc 32.

Figure 5A:
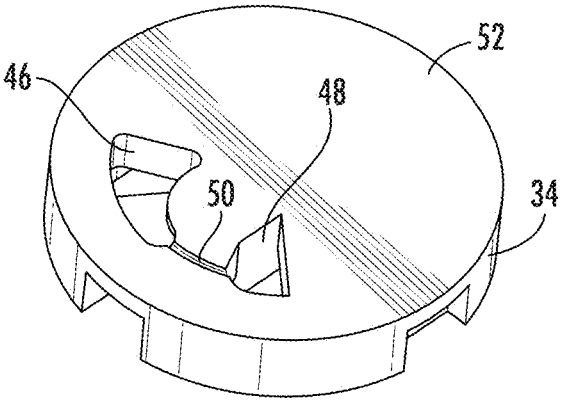
FIG. 5A is a perspective view of a first side of a stationary valve disc of the bidet apparatus constructed in accordance with the present disclosure.
Figure 5B:
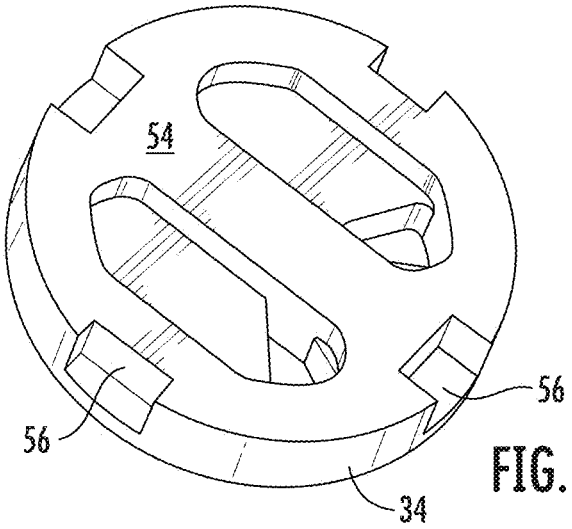
FIG. 5B is a perspective view of a second side of the stationary valve disc of the bidet apparatus constructed in accordance with the present disclosure.

Referring now to FIGS. 5A and 5B, the stationary valve disc 34 is disposed adjacent to the rotary valve disc 32 includes a wash port 46 to direct fluid to the wash outlet 28 of the valve housing 24, a spray port 48 to direct fluid to the spray outlet 30 of the valve housing 24 and a channel 50, or gutter, disposed in a first side 52 of the stationary valve disc 34 that fluidically connects the wash port 46 to the spray port 48. The channel 50 of the stationary valve disc 34 can have a defined depth and does not extend entirely through the stationary valve disc 34. The first side 52 of the stationary valve disc 34 being the side that is adjacent to the rotary valve disc 32. The channel 50 allows some fluid to be directed to the nozzle 20 to flush residual water out of the nozzle 20 when fluid is flowing through the wash port 46 and prior to directing the water fully to the spray port 48 and thus, the nozzle 20. The second side 54 of the stationary valve disc 34 can include recessed areas 56, or notches, that can engage with a part of the valve housing 24 to prevent rotation of the stationary valve disc 34 in the valve housing 24.

Figure 6:
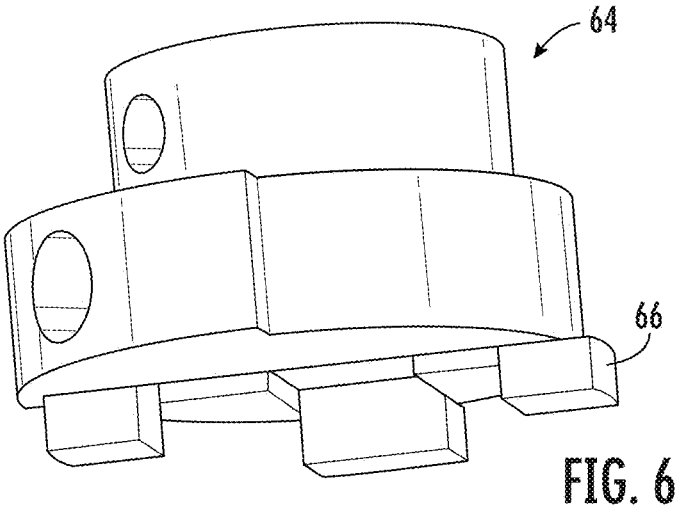
FIG. 6 is a perspective view of a rotary disc driver of the bidet apparatus constructed in accordance with the present disclosure.
Figure 7A:
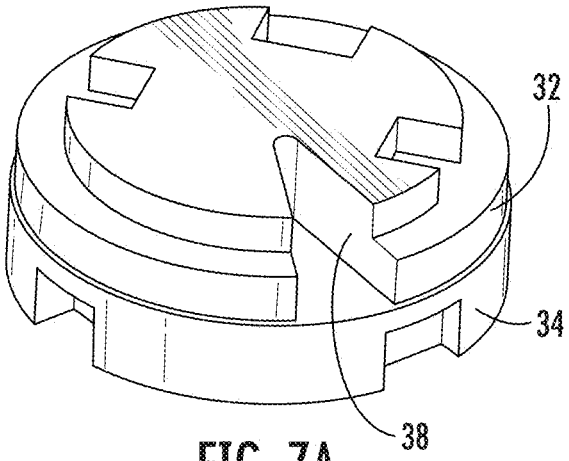
FIGS. 7A-7D are perspective views of various rotational relationships of the rotary valve disc and the stationary valve disc of the bidet apparatus constructed in accordance with the present disclosure.
Figure 7B:
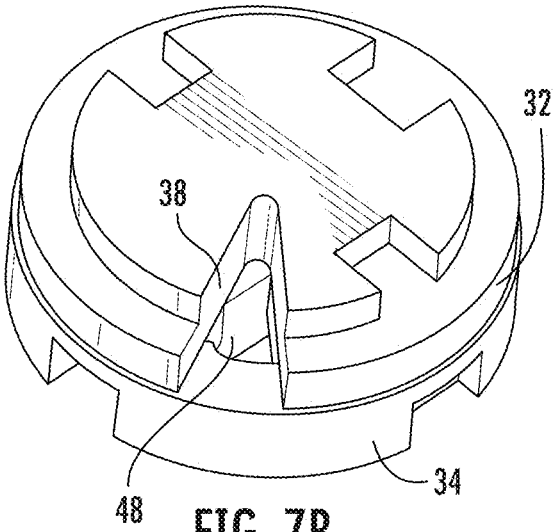
Figure 7C:
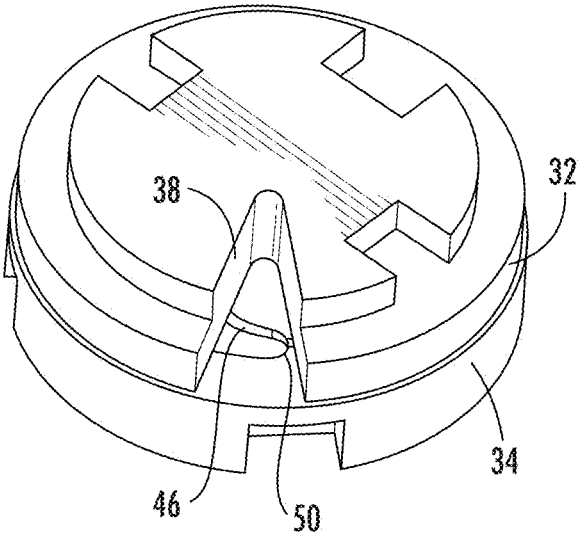
Figure 7D:
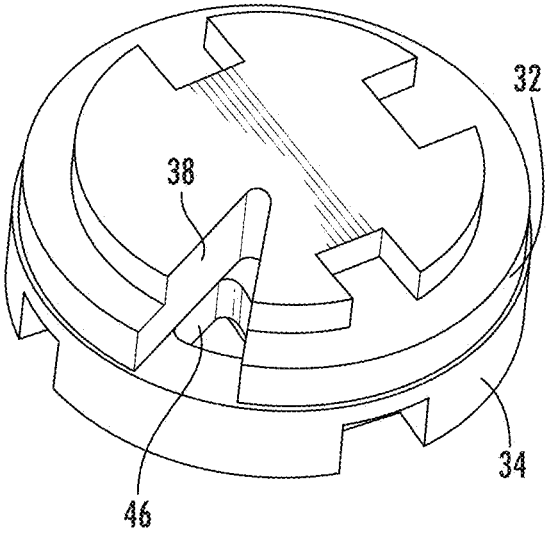
Figure 8A:
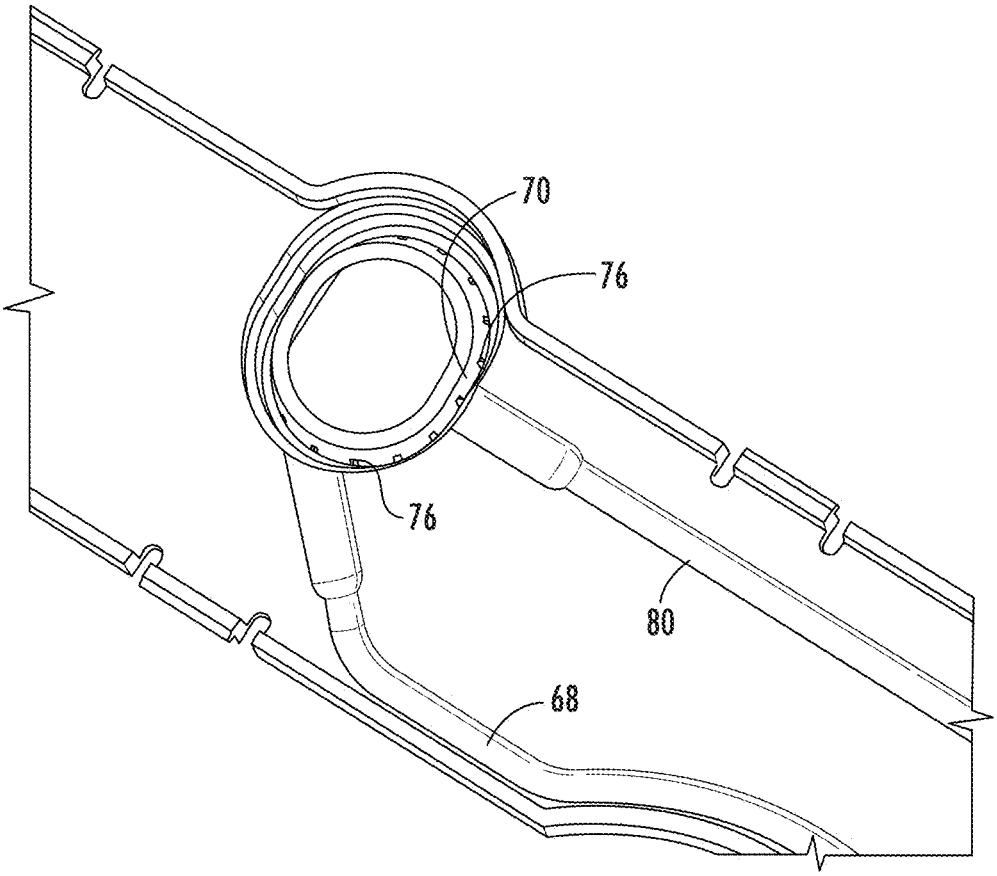
FIGS. 8A and 8B are perspective views of certain parts of the bidet apparatus constructed in accordance with the present disclosure.
Figure 8B:
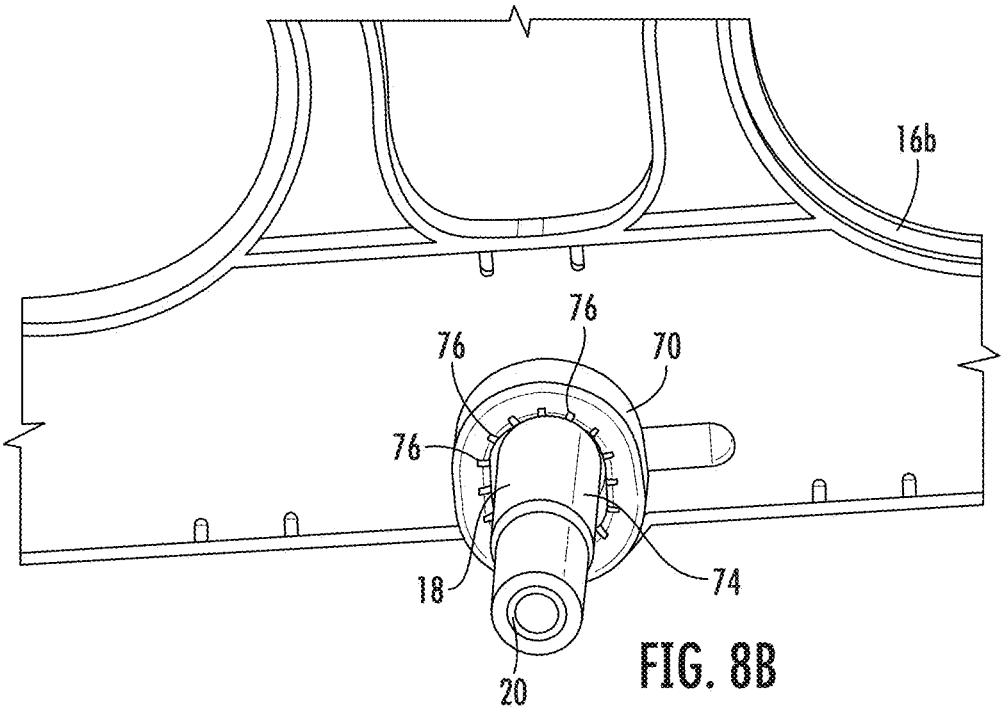
Figure 9A:
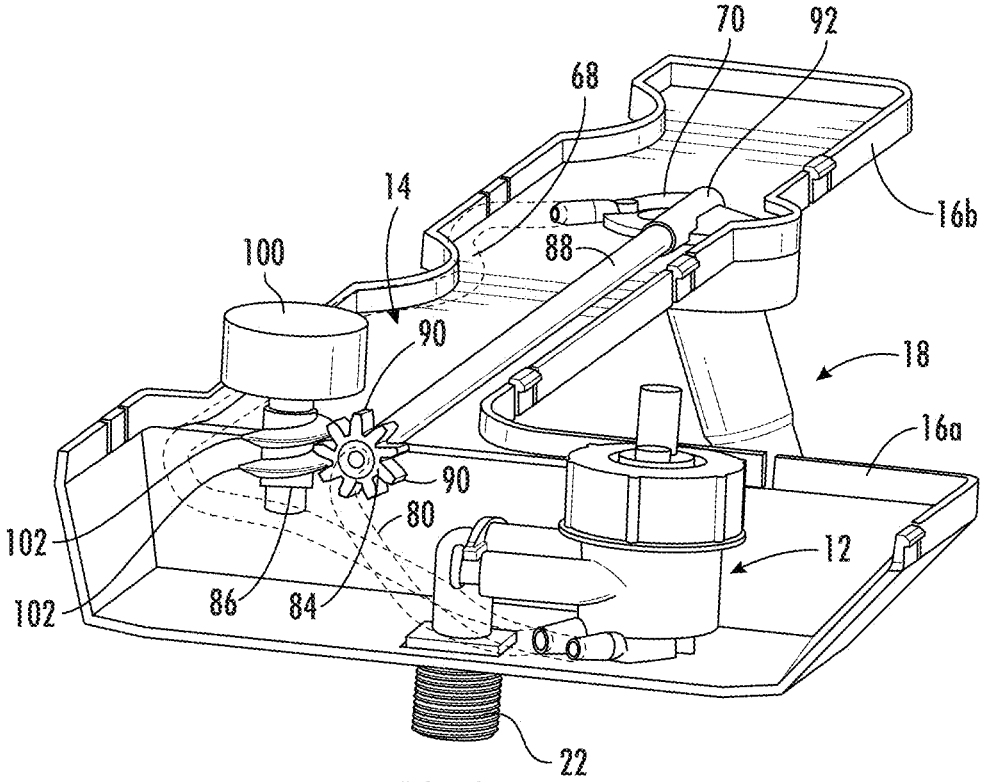
FIGS. 9A and 9B are perspective views of certain other parts of the bidet apparatus constructed in accordance with the present disclosure.
Figure 9B:
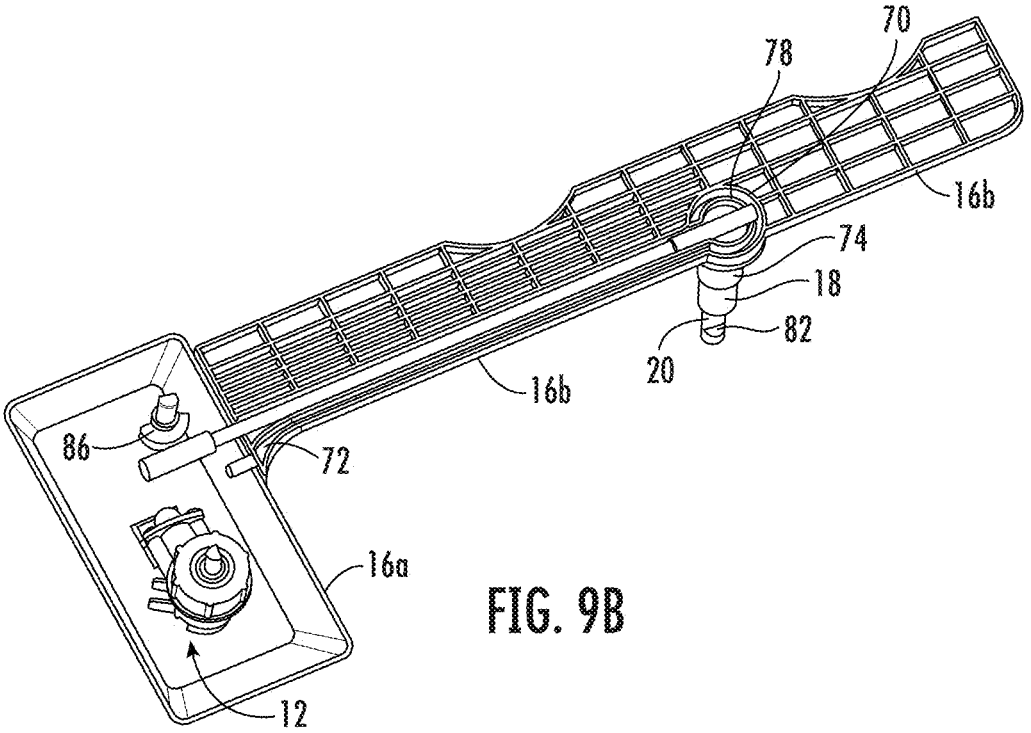

The actuation assembly 26 of the valve assembly 12 can include any number of parts such that it can engage with the rotary valve disc 32 to rotate the rotary valve disc 32 to allow the flow of water through the valve housing 24 as desired. In one embodiment, the actuation assembly 26 includes a valve stem 58 that supports a valve knob 60 that a user can turn to turn the valve stem 58 which transfers the rotational movement to the rotary valve disc 32. More specifically, the valve knob 60 can be supported by a valve stem end 62 that extends up an out of the valve housing 24. The valve stem 58 can directly contact the rotary valve disc 32, or it can include a rotary disc driver 64 (see FIGS. 3 and 6) extending radially from the valve stem 58 that engages parts of the rotary valve disc 32. More specifically, the rotary disc driver 64 can include keys 66 extending therefrom that can engage the notches 40 in the rotary valve disc 32. The valve assembly 12 can include appropriate sealing devices between the valve stem 58 of the actuation assembly 26 and other parts of the actuation assembly 26 to prevent the water from escaping the valve assembly 12 at places other than where desired.

Referring to FIGS. 7A-9B, when the rotary valve disc 32 is in a washing position, the wash outlet 28 can provide the washing fluid (or water) to the sprayer apparatus 18 via a wash conduit 68 that delivers the washing fluid to a ring-shaped wash basin 70, or wash ring, of the sprayer apparatus 18. In another embodiment of the present disclosure, the washing fluid can be fed to the wash basin 70 via a channel 72 built into the housing 16 of the bidet apparatus 10. The channel 72 could be built into parts of the operational housing 16*a* and/or the sprayer housing 16*b*. The channel 72 can be built into any part of the housing such that the washing fluid is delivered to the wash basin 70. The washing fluid can be fed to the channel 72 from the wash outlet 28 of the valve assembly 12 via any manner known to one of ordinary skill in the art, such as via tubing. The washing fluid is fed to the wash basin 70, which is disposed around an upper part 74 of the sprayer 18*a* and has small openings 76. The small openings 76 are disposed around an inside part 78 of the wash basin 70 and permit the washing fluid to escape the wash basin 70 and be directed toward the sprayer 18*a*. The washing fluid directed toward the upper part 74 of the sprayer 18*a* flows down and around the sprayer 18*a* to clean the sprayer 18*a*. When the rotary valve disc 32 is turned to a certain degree the washing fluid is permitted to flow from the wash outlet 28 to direct the water to the sprayer 18*a* as described. Some of the washing fluid can also be directed to the spray outlet 30 via the channel 50 in the stationary valve disc 34. This permits fluid to flow to and through the nozzle 20 in the sprayer 18*a* to force out any washing fluid remaining in the nozzle 20 from the previous cleaning or washing cycle. The fluid pressure of the washing fluid provided to the nozzle 20 via the channel 50 in the stationary valve disc 34 is not enough to cause the washing fluid to be propelled out of the nozzle 20 to perform a cleaning of the user of the bidet apparatus 10.

As the rotary valve disc 32 is rotated to a cleaning position, the spray outlet 30 can provide the washing fluid (or water) to the sprayer apparatus 18 via a spray conduit 80 that delivers the washing fluid to inside the sprayer 18*a* to the nozzle 20 of the sprayer apparatus 18. The delivery of the washing fluid to the nozzle 20 causes the nozzle 20 to extend from the sprayer 12*a* and provides enough water pressure to force the washing fluid from an orifice 82 of the nozzle with enough velocity to contact the area of the user to be cleaned with sufficient force to remove debris from the user. When the rotary valve disc 32 is in the cleaning position, the channel 50 in the stationary valve disc 34 allows for some of the washing fluid to travel to the wash port 46 and to the wash basin 70. The washing fluid directed to the wash basin 70 during the cleaning cycle permits the washing fluid to be directed to the outside of the sprayer 18*a* and nozzle 20 to prevent debris from the user from sticking to the sprayer 18*a* or nozzle 20 during a cleaning cycle.

Figure 10A:
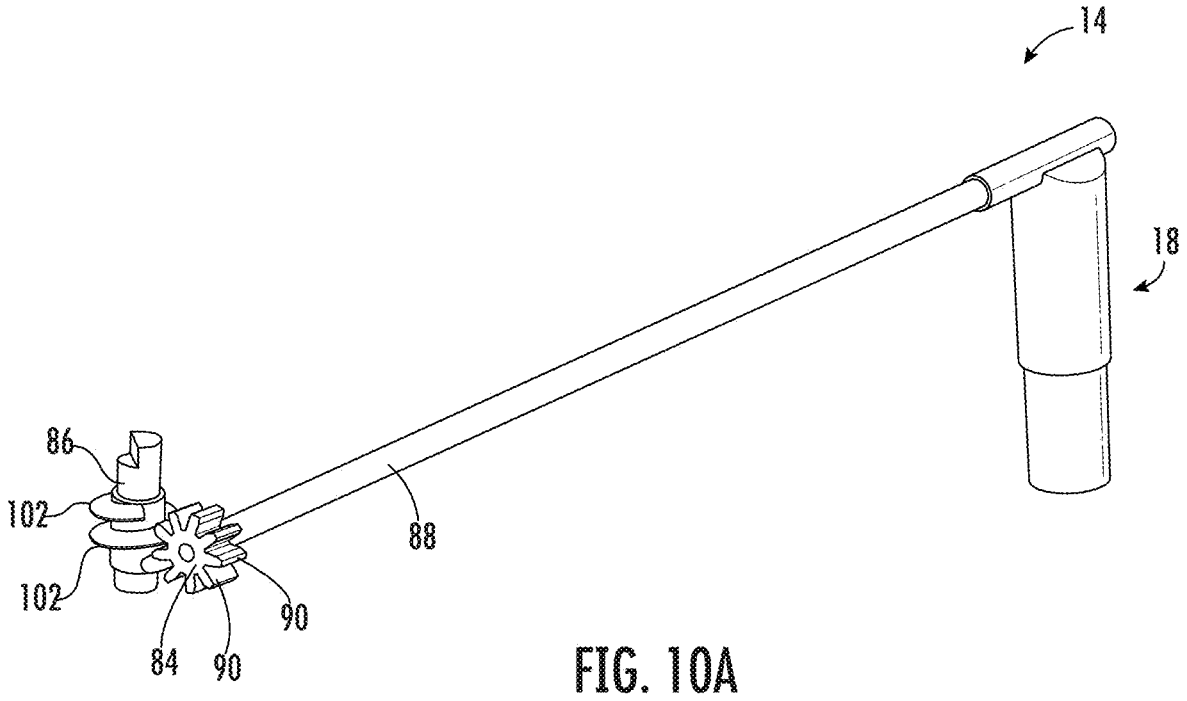
FIGS. 10A and 10B are perspective views of additional parts showing various embodiments of the bidet apparatus constructed in accordance with the present disclosure.

Referring now to FIG. 10A, the nozzle adjustment assembly 14 includes operational components that can be included in the operational housing 16*a* portion of the housing 16 and certain components that are contained in the sprayer housing 16*b*. In one embodiment, the nozzle adjustment assembly 14 includes a gear element 84 that is linked to the sprayer 18*a* and a screw mechanism 86 that engages the gear element 84. When the screw mechanism 86 is turned the gear element 84 is rotated. The gear element 84 can be linked to the sprayer 18*a* via a rod member 88 that is attached to the gear element 84 on a first end of the rod element 88. The gear element 84 can have any number of teeth 90 such that its engagement with the screw mechanism 86 rotates the gear element 84. In one embodiment, the gear element 84 could have only a single tooth 90 that engages the screw mechanism 86. The single tooth 90 is rotated up or down depending upon the direction the screw mechanism 86 is rotated. The second end of the rod element 88 can include a sleeve 92 that is attached to the sprayer 18*a*. Therefore, when the screw mechanism 86 is rotated, the rod element 88, the sleeve 92 attached to the second end of the rod element 88 and the sprayer 18*a* attached to the sleeve 92 are rotated. This rotation allows a user of the bidet apparatus 10 to adjust the angle of the nozzle 20, which is supported by the sprayer 18*a*, and the water sprayed at the area of the user to be cleaned. The sleeve 92 can be longer than the upper part 94 of the sprayer apparatus 18 is wide so that the outer part(s) 96 of the sleeve 92 can engage with a depressed area 98 in an upper part 94 of the wash basin 70 to facilitate rotation of the sprayer 18 and nozzle 20. The nozzle adjustment assembly 14 can include a sprayer knob 100 on the outside of the operational housing 16*a* connected to the screw mechanism 86 such that rotation of the sprayer knob 100 rotates the screw mechanism 86. In this embodiment, the screw mechanism 86 can be vertically disposed so that rotation of the screw mechanism 86 causes the threads 102 of the screw mechanism 86 to engage the teeth 90 of the gear element 84 to rotate the gear element 84.

Figure 10B:
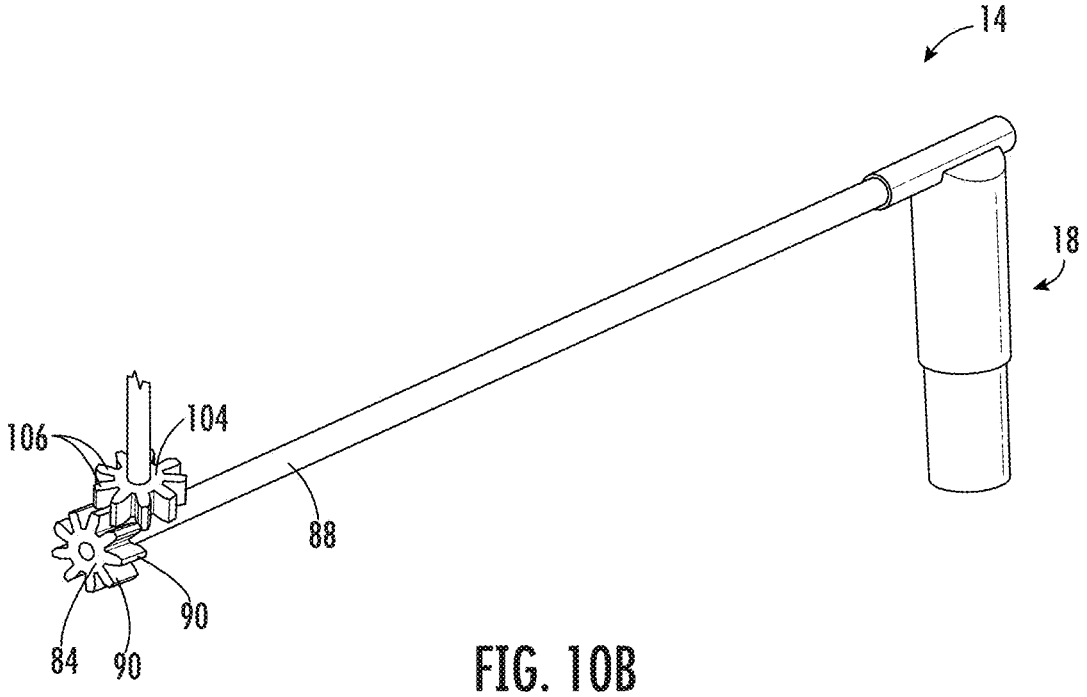

In another embodiment of the present disclosure shown in FIG. 10B, the screw mechanism 86 of the nozzle adjustment assembly 14 could be replaced with a gear member 104 that is operationally connected to the sprayer knob 100 that has teeth 106 that can engage the teeth 90 of the gear element 84. Thus, when the sprayer knob 100 is rotated, the gear member 104 is rotated, and its teeth 106 force the teeth 90 of the gear element 84 to rotate the gear element 84. When the gear element 84 is rotated, the angle of the sprayer 18 is changed. The orientation of the gear element 84 and the gear member 104 depends on the location of the sprayer knob 100. The nozzle adjustment assembly 14 is designed such that rotational movement of the sprayer knob 100 is translated to rotating the sprayer 18 which changes the angle of the sprayer/nozzle.

It is contemplated that the sprayer knob 100 could be directly linked to the rod element 88 wherein rotation of the sprayer knob 100 directly rotates the rod element 88, which rotates the sprayer 18 changing its spray angle. In this embodiment, the sprayer knob 100 would be disposed on the side of the operational portion of the housing. In another contemplated embodiment, the sprayer knob 100 could be disposed on the side of the sprayer housing 16*b* and the rod element 88 extends from the sprayer knob 100 disposed on the side of the sprayer housing 16*b* to the sprayer 18.

It is also contemplated that a lever (not shown) could be incorporated that is attached to the rod element 88 and extends up through a slot in the operational housing 16*a*. The rod element 88 is rotated, thus rotating the sprayer 18 and adjusting its spray angle, when the lever is moved in one direction or another. In an alternative embodiment, the lever could be disposed on the side of the operational housing 16*a* or the side of the sprayer housing 16*b* wherein rotation of the lever rotates the rod element 88, thus rotating the sprayer 18 and changing the angle of the sprayer 18.

In this embodiment, the rod element 88 of the nozzle adjustment assembly 14 can be hollow and used to deliver the washing fluid to the sprayer 18 and nozzle 20. The rod element 88 can be fluidically linked to the spray outlet 30 via a spray conduit.

In another embodiment, the sprayer knob 100 could be disposed on the side of the operational housing 16*a* wherein the sprayer knob 100 could directly rotate the rod element 88 without the use of a screw mechanism or a gear element. In this embodiment, the rod element 88 could still be used to deliver the washing fluid to the sprayer or the washing fluid could be delivered to the sprayer apparatus via a sprayer conduit that runs directly from the spray outlet of the valve assembly to the sprayer apparatus.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A bidet apparatus for controlling the flow of fluid, the bidet apparatus comprising:

a valve assembly including a rotary valve disc and a stationary valve disc, the rotary valve disc having an opening;

a sprayer apparatus in fluid communication with the valve assembly, the valve assembly providing a washing fluid to an outside surface of a sprayer of the sprayer apparatus and to an inside part of the sprayer and a nozzle disposed within the sprayer;

a wash port disposed in the stationary valve disc for providing the washing fluid to the outside surface of the sprayer;

a spray port disposed in the stationary valve disc to direct the washing fluid to the inside part of the sprayer and the nozzle; and a channel disposed on a first side of the stationary valve disc to fluidically connect the wash port and the spray port to direct some of the washing fluid to the spray port when the washing fluid is directed to the wash port.

2. The bidet apparatus of claim 1 wherein the sprayer is rotatably disposed within the bidet apparatus so the angle of the water sprayed from the nozzle of the apparatus can be changed.

3. The bidet apparatus of claim 2 further comprising a nozzle adjustment mechanism to change the angle of the sprayer.

4. The bidet apparatus of claim 3 wherein the nozzle adjustment mechanism comprises:

a gear element;

a rod member supporting the gear element on a first end and rotatably supporting the sprayer on a second end; and a gear member engaged with the gear element that rotates the gear element and rod member when the screw mechanism is rotated.

5. The bidet apparatus of claim 1 wherein the washing fluid can be directed to the outside surface of the sprayer and the nozzle through the inside of the sprayer simultaneously.

6. The bidet apparatus of claim 1 wherein a rotary disc driver includes keys extending therefrom that engage notches in the rotary valve disc to rotate the rotary valve disc.

7. The bidet apparatus of claim 1 wherein the opening in the rotary valve disc is wider at an outer part of the rotary valve disc and narrows in a radially inward direction.

8. The bidet apparatus of claim 1 wherein the spray port is narrower at a first side that is adjacent to the channel and wider on a second side farther from the channel.

9. A bidet apparatus for controlling the flow of fluid, the bidet apparatus comprising:

a valve assembly including a rotary valve disc and a stationary valve disc, the rotary valve disc having an opening;

a sprayer apparatus in fluid communication with the valve assembly, the valve assembly providing a washing fluid to an outside surface of a sprayer of the sprayer apparatus and to an inside part of the sprayer and a nozzle disposed within the sprayer;

a wash port disposed in the stationary valve disc for providing the washing fluid to the outside surface of the sprayer;

a spray port disposed in the stationary valve disc to direct the washing fluid to the inside part of the sprayer and the nozzle; and a wash basin wherein washing fluid can be delivered thereto to direct the washing fluid to the outer surface of the sprayer, the wash basin is ring-shaped and disposed adjacent to an upper part of the sprayer apparatus.

10. The bidet apparatus of claim 9 wherein the wash basin has openings therein to permit the washing fluid to flow out of the wash basin and onto the outer surface of the sprayer.

11. The bidet apparatus of claim 9 wherein the sprayer is rotatably disposed within the bidet apparatus so the angle of the water sprayed from the nozzle of the apparatus can be changed.

12. The bidet apparatus of claim 11 further comprising a nozzle adjustment mechanism to change the angle of the sprayer.

13. The bidet apparatus of claim 9 wherein the washing fluid is delivered to the wash basin via tubing or via a channel disposed in a housing of the bidet apparatus.

14. A bidet apparatus for controlling the flow of fluid, the bidet apparatus comprising:

a valve assembly including a rotary valve disc and a stationary valve disc, the rotary valve disc having an opening;

a sprayer apparatus in fluid communication with the valve assembly, the valve assembly providing a washing fluid to an outside surface of a sprayer of the sprayer apparatus and to an inside part of the sprayer and a nozzle disposed within the sprayer, the sprayer is rotatably disposed within the bidet apparatus so the angle of the water sprayed from the nozzle of the apparatus can be changed;

a wash port disposed in the stationary valve disc for providing the washing fluid to the outside surface of the sprayer;

a spray port disposed in the stationary valve disc to direct the washing fluid to the inside part of the sprayer and the nozzle; and a nozzle adjustment mechanism to change the angle of the sprayer, the nozzle adjustment assembly comprises:

a gear element;

a rod member supporting the gear element on a first end and rotatably supporting the sprayer on a second end, the washing fluid delivered to the wash basin via the rod element; and a screw mechanism engaged with the gear element that rotates the gear element and rod member when the screw mechanism is rotated.

15. The bidet apparatus of claim 14 wherein the nozzle extends out of the sprayer when the pressure of the fluid being directed to it rises above a certain point.

16. The bidet apparatus of claim 14 wherein the valve assembly includes a rotary disc driver for engaging the rotary valve disc and rotating it relative to the stationary valve disc.

17. The bidet apparatus of claim 14 wherein the washing fluid can be directed to the outside surface of the sprayer and the nozzle through the inside of the sprayer simultaneously.

18. The bidet apparatus of claim 16 wherein the rotary disc driver includes keys extending therefrom that engage notches in the rotary valve disc to rotate the rotary valve disc.

19. The bidet apparatus of claim 14 wherein the opening in the rotary valve disc is wider at an outer part of the rotary valve disc and narrows in a radially inward direction.

20. The bidet apparatus of claim 14 wherein the stationary disc includes notches therein to engage areas of a valve housing to prevent the stationary disc from rotating.

* * * * *